United States Patent [19]

Ishikawa et al.

[11] 4,091,755

[45] May 30, 1978

[54] THREAD WINDING MECHANISM FOR A SEWING MACHINE

[75] Inventors: Hitoshi Ishikawa, Toyota; Kimihiko Yamamoto, Nagoya; Toshio Sawada, Okazaki; Takahiko Kasahara, Anjo, all of Japan

[73] Assignee: Aisin Seiki Kabushiki Kaisha, Kariya, Japan

[21] Appl. No.: 740,754

[22] Filed: Nov. 10, 1976

[30] Foreign Application Priority Data

Nov. 13, 1975 Japan ..... 50-155000[U]

[51] Int. Cl.[2] ..... D05B 59/00; B65H 54/18

[52] U.S. Cl. ..... 112/279

[58] Field of Search ..... 112/218 A, 218 R, 220, 112/279, 283; 242/20, 23

[56] References Cited

U.S. PATENT DOCUMENTS

| | | | |
|---|---|---|---|
| 1,940,435 | 12/1933 | Orvis | 112/220 X |
| 2,173,286 | 9/1939 | Robert | 112/220 |
| 2,838,020 | 6/1958 | Eriksson | 112/220 |
| 3,635,412 | 1/1972 | Perlino | 112/218 A |
| 3,869,030 | 3/1975 | Masaki | 112/220 |

FOREIGN PATENT DOCUMENTS

| | | | |
|---|---|---|---|
| 1,046,442 | 7/1953 | France | 112/218 A |
| 246,965 | 11/1947 | Switzerland | 112/218 A |
| 638,685 | 6/1950 | United Kingdom | 242/20 |

*Primary Examiner*—H. Hampton Hunter

*Attorney, Agent, or Firm*—Burns, Doane, Swecker & Mathis

[57] ABSTRACT

A thread winding mechanism for a sewing machine head includes a main drive shaft for operating the sewing components and which is rotatably mounted within the head of the machine, a flywheel rotatably mounted on the drive shaft, a clutch for connecting and disconnecting the flywheel from the drive shaft, and a motor for driving the flywheel. A thread winding shaft is formed integrally with and extends axially outward from one end of the flywheel to the exterior of the head and a clutch operating handwheel mounted on and rotatable with the flywheel and which likewise extends outside the head can be shifted axially between an inward position wherein the flywheel is disconnected from the drive shaft and the thread winding shaft is exposed, and an outward position wherein the flywheel is connected to the drive shaft and the thread winding shaft is concealed within the handwheel.

2 Claims, 4 Drawing Figures

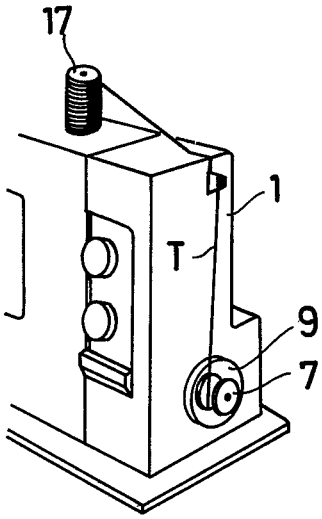
FIG. 4
FIG. 2
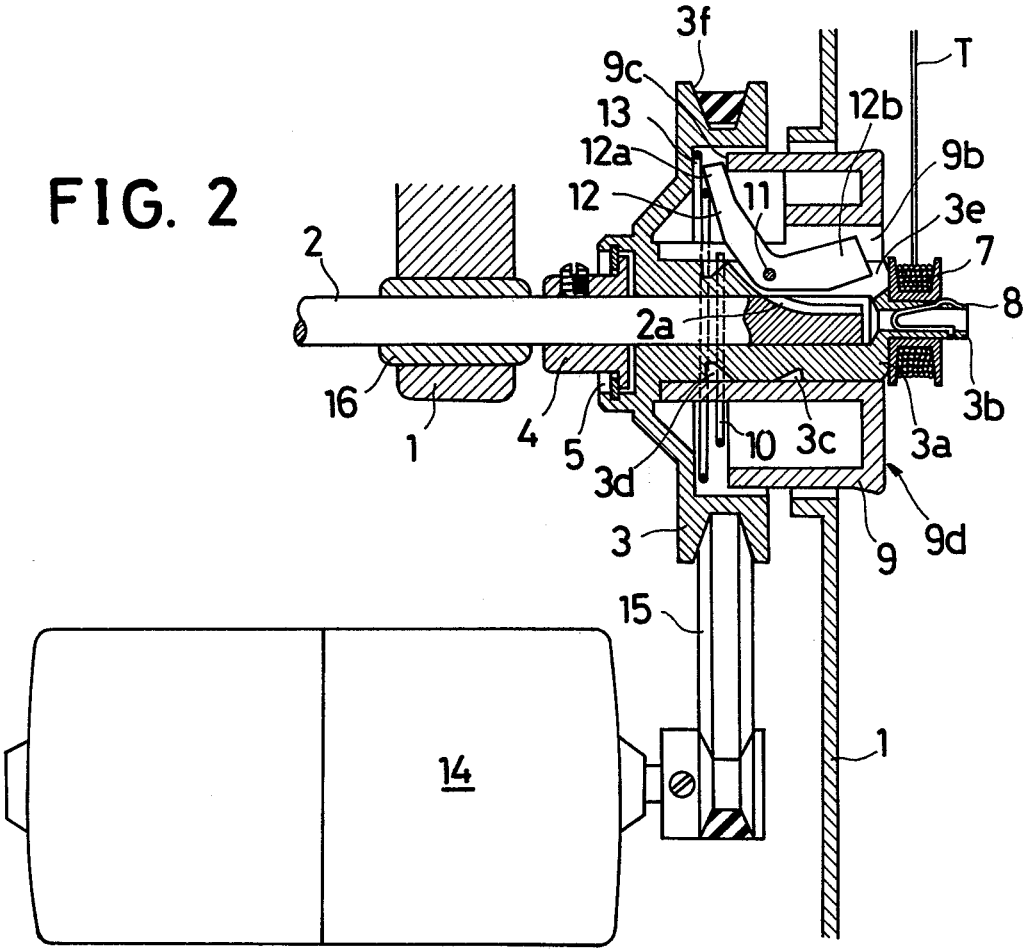

THREAD WINDING MECHANISM FOR A SEWING MACHINE

BACKGROUND OF THE INVENTION

1. Field of Invention

The invention relates in general to sewing machines and more particularly to an improvement in a thread winding mechanism on the machine.

2. Description of the Prior Art

In a sewing machine of the conventional type, the speed of the thread winding shaft is different from that of the flywheel and handwheel which results in an unnecessary increase in the speed of the thread winding shaft. Moreover, since the thread winding shaft on a conventional machine extending outwardly from the head of the machine is always exposed it is subject to damage and is also objectionable from a standpoint of overall appearance when the machine is being used for sewing rather than for thread winding.

SUMMARY OF THE INVENTION

An object of the invention is to provide an improved thread winding mechanism of a sewing machine wherein the speed of the winding shaft is the same as those of the flywheel and handwheel.

A further object of the invention is to provide an improved thread winding mechanism of a sewing machine wherein the thread winding shaft is formed integrally with and projects axially outward from the flywheel and is concealed within the handwheel mounted on the flywheel when the machine is being used for sewing.

More specifically, the improved thread winding mechanism for a sewing machine includes a main drive shaft for operating the sewing components and which is rotatably mounted within the head of the machine, a flywheel rotatably mounted on the drive shaft, a clutch for connecting and disconnecting the flywheel from the drive shaft, and a motor for driving the flywheel. A thread winding shaft is formed integrally with and extends axially outward from one end of the flywheel to the exterior of the head and a clutch operating handwheel mounted on and rotatable with the flywheel and which likewise extends outside the head can be shifted axially between an inward position wherein the flywheel is disconnected from the drive shaft and the thread winding shaft is exposed, and an outward position wherein the flywheel is connected to the drive shaft and the thread winding shaft is concealed within the handwheel.

BRIEF DESCRIPTION OF DRAWINGS

With reference now to the drawings which illustrate a preferred embodiment of the invention.

FIG. 2 is a view similar to FIG. 1, the flywheel being shown in the clutched-out position from the main drive shaft for performing a thread winding operation;

FIG. 4 is a perspective view of a portion of the head of the sewing machine showing the handwheel in its axially inward position for thread winding, the bobbin having been mounted on the now exposed winding shaft end of the flywheel and connected up to a thread supply spool.

DETAILED DESCRIPTION OF PREFERRED EMBODIMENT

Figure 1:
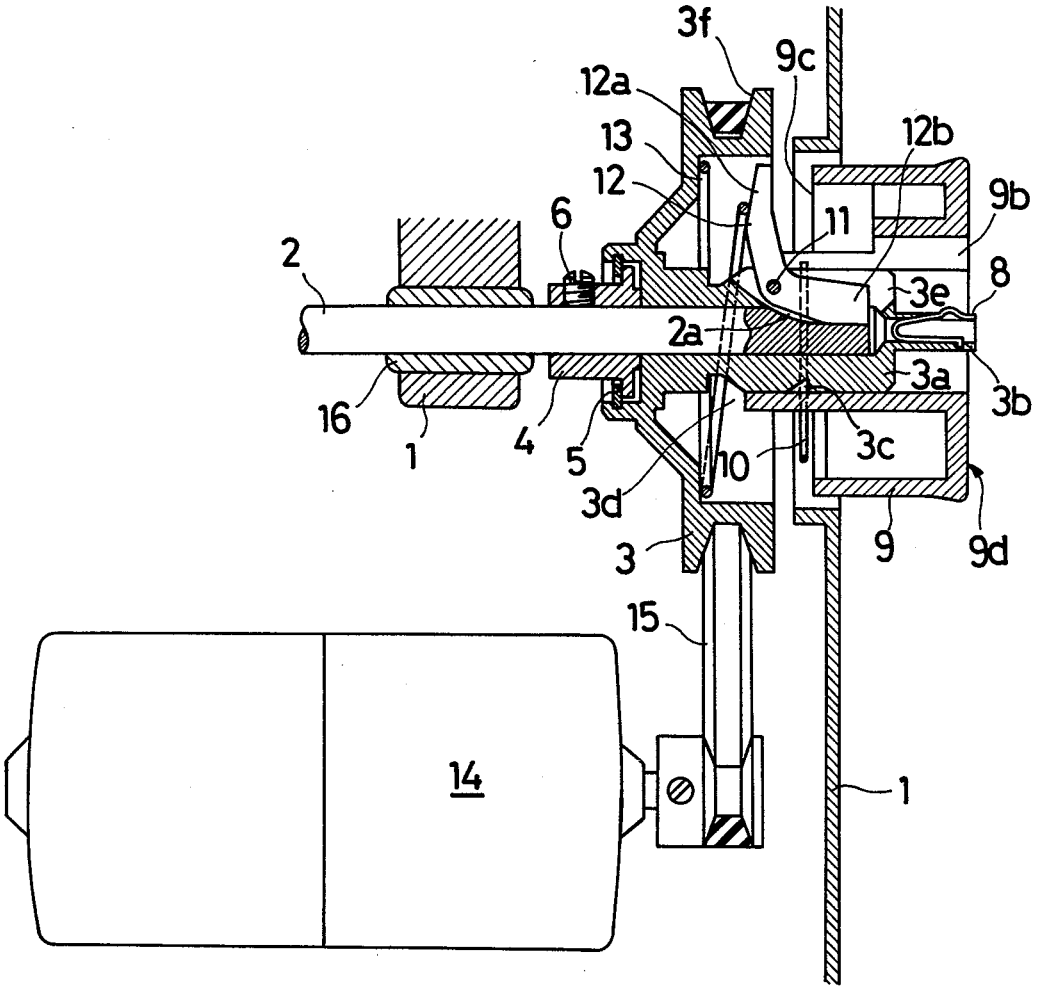
FIG. 1 is a cross sectional view of a portion of the head of a sewing machine showing the main drive shaft, flywheel, handwheel and drive motor components in accordance with the invention, the flywheel being shown in the clutched-in position to the main drive shaft for performing a stitching operation.
Figure 3:
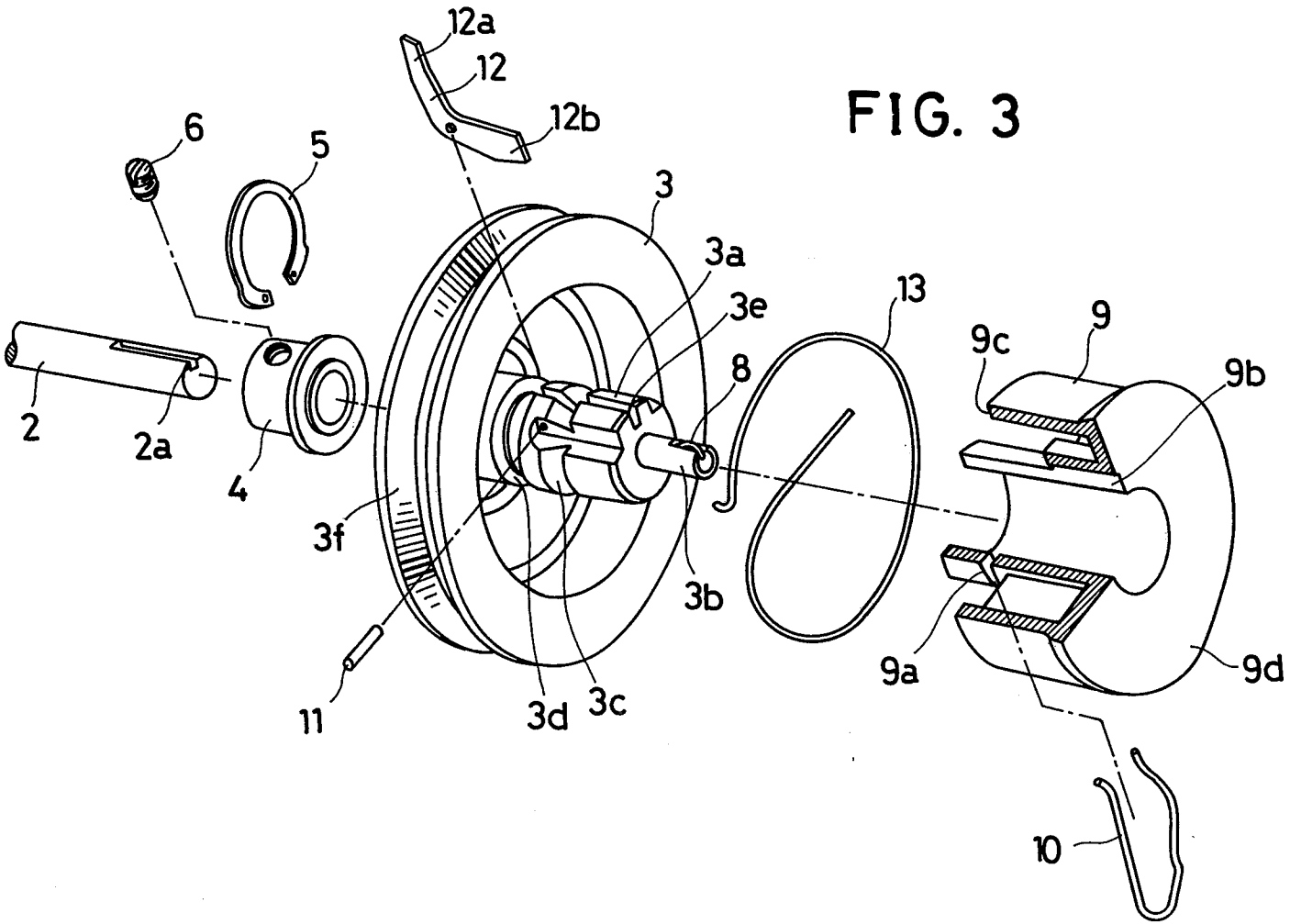
FIG. 3 is an exploded view of the various operating components which make up the assembly of the main drive shaft, flywheel, clutch, and handwheel.

With reference now to the drawings, numeral 1 designates generally the head portion of the machine as depicted partly in FIG. 4. As shown in FIGS., 1 and 2, included within the head is a main drive shaft 2 which drives a conventional stitching mechanism, the shaft 2 being rotationally supported within a sleeve 16. A flywheel 3 is rotatably mounted on the main shaft 2 but is retrained against any axial displacement thereon by a detent member 4 on shaft 2, a stop ring 5 and a set screw 6 which secures the detent 4 to the shaft.

The flywheel 3 includes a hollow shaft portion **3*a* coaxial with the main shaft 2 and a bobbin winding shaft portion 3*b* which is integral with it and projects outwardly from the head 1 as depicted in FIGS. 1 and 2 and also in FIG. 4. A detent spring 8 is disposed in the shaft winding portion 3*b* of the flywheel for securing the bobbin 7 in place for thread winding when the handwheel 9 is in the position depicted in FIG. 2**.

The handwheel 9 is mounted on the shaft portion **3*a* of the flywheel 3 for movement in an axial direction between the positions depicted respectively in FIGS. 1 and 2 and is engaged with this shaft portion 3*a* by means of a U-shaped clip 10 compressibly disposed between a groove 9*a* in the handwheel 9 and recesses 3*c* or 3*d* provided in the shaft portion 3*a***.

Handwheel 9 is provided with an axially extending groove **9*b* for receiving an L-shaped clutch plate 12 which is pivotally mounted by means of a pivot pin 11 for movement in an axial groove 3*e* of the flywheel. The handwheel 9 rotates with the flywheel 3 and, as previously indicated, is slidable axially along the shaft portion 3*a*, and extends outwardly beyond the head 1**.

During a sewing operation clutch plate 12 is biassed toward the right, i.e. in the clockwise direction as viewed in FIG. 1 by a spring 13 which engages the end **12*a* and is in engagement with the main shaft 2 when the handwheel 9 occupies its rightward position as depicted in FIG. 1 due to the fact that the other end 12*b* of the clutch plate is forced into an axial groove 2*a* of the main shaft 2** during one revolution of the flywheel.

Flywheel 3 is provided with a V-shaped groove **3*f* on its periphery for receiving a V-shaped drive belt 15, the latter being connected to a V-shaped drive pully 14*a* of electric motor 14**.

Operation

When a normal sewing operation is to be performed, the component parts of the mechanism are in the position depicted in FIG. 1. Motor 14 is energized so as to drive the flywheel 3 by means of the belt connection 15. End **12*b* of the clutch plate 12 which is pivotally mounted on the flywheel has been moved through groove 3*e* in flywheel 3 into groove 2*a* of the main shaft 2 thus coupling flywheel 3 to shaft 2, and rotation of shaft 2 is transmitted to the essential elements of a conventional sewing mechanism (not shown) of the machine for performing a conventional sewing operation. Simultaneously the hand wheel 9 will also be rotated with flywheel 3 since the end 12*a* of clutch plate 12 is disposed in groove 9b of the handwheel. The outer end face 9d of the handwheel 9 is positioned in substantially the same plane as the outer face of the bobbin winding portion 3b** so as to cover the latter.

When it is desired to perform a bobbin winding operation, handwheel 9 is pushed to the left into the position depicted in FIG. 2. Stop ring 10 which had been disposed in recess 3c of the flywheel will now be forced to the left and come to lie in recess 3d. Due to the leftward movement of handwheel 9 relative to flywheel 3, the bobbin winding extension 3b of the flywheel will now be exposed for receiving the bobbin 7, the bobbin being held upon the extension 3b by the spring detent 8. Simultaneously with movement of the handwheel 9 to the left the left end surface 9c of the handwheel is forced into engagement with end 12a of clutch plate 12 against a counter biasing force exerted by spring 13 thereby rotating plate 12 in a counterclockwise direction about pivot pin 11 so as to dis-engage the other end 12b from groove 2a of the main shaft 2. The handwheel 9 is held in the left position on the flywheel by the engagement of the U-shaped clip member 10 in the recess 3d on the shaft portion 3a of the flywheel. Bobbin 7 is then pushed onto the extension 3b over the spring detent 8 so as to hold the bobbin against rotation relative to the extension 3b and motor 14 is then started which results in rotation of flywheel 3 and bobbin 7. Shaft 2 will remain stationary since it has been uncoupled from the flywheel due to disengagement of clutch plate 12 from the shaft groove 2a as end face 9c of the handwheel 9 engages end 12a of the clutch plate and rotates the latter counterclockwise while compressing spring 13. The thread T is supplied to the bobbin 7 from a spool 17 rotatably mounted on a bobbin winder spindle upstanding on the head 1 as illustrated in FIG. 4.

After a thread winding operation on bobbin 7 is completed, normal sewing operations can then be resumed by shifting the handwheel 9 back to the right to the position indicated in FIG. 1. This causes clip member 10 to shift to the right from recess 3d to recess 3c so as to retain the handwheel 9 in that position. Simultaneously with this movement of the handwheel 9, the bobbin winding extension 3b will have again become concealed within the handwheel and the left end face 9c of the handwheel will have been disengaged from the end 12a of clutch plate 12 whus permitting the clutch plate 12 to be rotated in a clockwise direction by the force of spring 13 thereby causing the other end 12b to be reseated in groove 2a of shaft 2 thereby re-coupling the flywheel 9 and shaft 2 for rotation together.

As described hereinabove, according to the present invention since the thread winding shaft on which the bobbin is mounted is formed integrally with the flywheel so that the rotational velocity of the winding shaft is the same as those of the flywheel and handwheel, the rotational speed of the thread winding shaft will not be unnecessarily increased as has often occurred with other known bobbin winding devices.

Furthermore, since the thread winding shaft is concealed during normal sewing operations, the overall appearance of the entire sewing machine is greatly enhanced.

We claim:

1. A thread winding mechanism for a sewing machine comprising:

a main drive shaft for a sewing mechanism rotatably mounted on a head part of the machine, a flywheel rotatably mounted on said drive shaft but restrained against axial movement relative thereto, a drive motor, means coupling said drive motor with said flywheel, a thread winding shaft integral with and extending outwardly from one end of said flywheel for receiving a bobbin to be wound, clutch means mounted on said flywheel for connecting and disconnecting said main drive shaft with said flywheel, and a handwheel mounted on said flywheel and rotatable therewith and surrounding said thread winding shaft, said handwheel also being movable in an axial direction on said flywheel from an outward position to an inward position to engage said clutch means and disconnect said main drive shaft from said flywheel and expose said thread winding shaft, the outer end face of said handwheel being located in substantially the same plane as the outer end face of said thread winding shaft thereby to conceal the latter when said handwheel occupies its outward position and said flywheel is connected to said main drive shaft by said clutch means.

2. A thread winding mechanism as set forth in claim 1 wherein said clutch means which is actuated by said handwheel includes an L-shaped clutch plate one end of which is engageable with a groove provided on said main drive shaft and the other end of which is engageable with a groove provided on said handwheel, and a pivot pin pivotally mounting the middle portion of said L-shaped clutch plate on said flywheel thereby to effect rotation of said main drive shaft, flywheel and handwheel in unison when said handwheel occupies its outward position.

* * * * *